United States Patent [19]

Eggert, Jr.

[11] Patent Number: 4,538,524

[45] Date of Patent: Sep. 3, 1985

[54] EQUALIZATION MEANS FOR A RAILWAY TRUCK

[75] Inventor: Walter S. Eggert, Jr., Huntington Valley, Pa.

[73] Assignee: The Budd Company, Troy, Mich.

[21] Appl. No.: 559,551

[22] Filed: Dec. 8, 1983

[51] Int. Cl.[3] ..... B61F 5/52

[52] U.S. Cl. ..... 105/182 R; 105/197 B; 105/198; 105/453

[58] Field of Search ..... 105/157 R, 182 R, 197 B, 105/198, 208.2, 453; 267/3, 153

[56] References Cited

U.S. PATENT DOCUMENTS

| | | | |
|---|---|---|---|
| 3,020,857 | 2/1962 | Dean | 105/193 |
| 3,646,893 | 3/1972 | Sundby | 105/197 B |
| 4,108,080 | 8/1978 | Garner et al. | 105/182 R |
| 4,398,468 | 8/1983 | Bell et al. | 105/182 R |
| 4,458,604 | 7/1984 | Cope | 105/182 R |

*Primary Examiner*—William A. Cuchlinski, Jr.
*Attorney, Agent, or Firm*—Edward M. Farrell; Herman Foster; T. I. Davenport

[57] ABSTRACT

A railway truck includes a pair of pivotable side frames connected by a pivot assembly which maintains the side frames in tram while still permitting equalization. Springs are connected between a car body and the side frames to provide equalization for the wheels on the truck. The springs also serve as the load transmission path from the car body to the side frames.

9 Claims, 7 Drawing Figures

FIG. 5
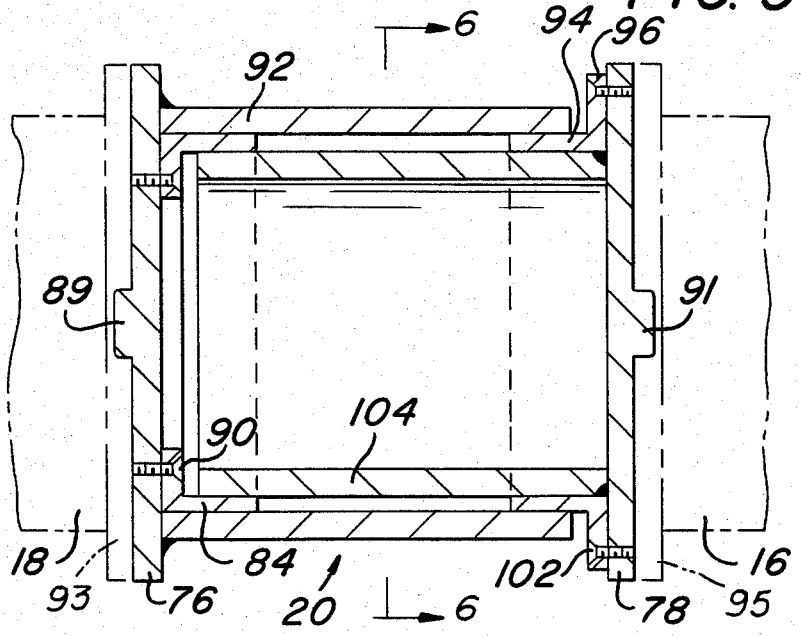
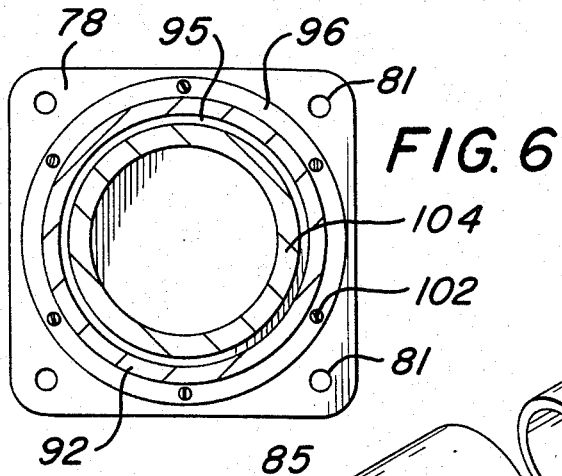
FIG. 6
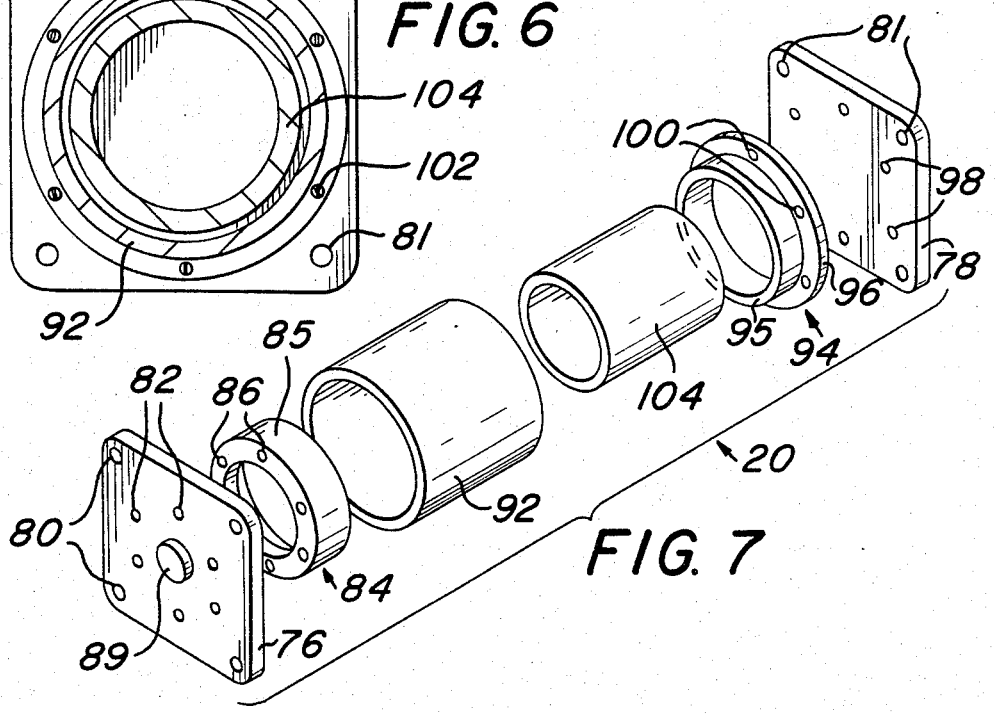
FIG. 7

EQUALIZATION MEANS FOR A RAILWAY TRUCK

BACKGROUND OF THE INVENTION

It is sometimes required to meet certain equalization standards in railway cars. In general, such equalization standards require that one wheel of the truck be lifted from a rail, for example, two inches without changing the load on the other three wheels beyond a prescribed amount. The reason for such equalization requirements is to assure that a wheel of a truck does not lose contact with the rail when the car is traveling over an uneven rail. One wheel leaving the rail could cause the car to derail.

Generally in equalizer beam systems, movable equalizer beams extend over the axles of two longitudinally spaced wheels. The ends of the beam includes guide sections which are adapted to slide up and down vertically on members associated with the wheels, with equalizer springs providing the force to keep all the wheels on the rails. While the use of equalizer beams is especially applicable in so called "fixed frame" trucks, they also are applicable in other types of trucks.

Other means for providing equalization are described in U.S. Pat. Nos. 3,313,245 and 3,646,893. Some of the basic truck design elements of the present invention are also found in U.S. Pat. Nos. 2,908,230 and 3,020,857.

Many conventional trucks utilize bolsters connected to the side frames with springs connected between the car body and the bolster. Generally the bolster has a center opening to receive a king pin connected to the car body. The load transmission path from the car body in these cases is through the king pin to the bolster. Such an arrangement, along with the equalization apparatus, makes the overall truck very heavy.

OBJECTS OF THE INVENTION

It is an object of this invention to provide an improved light weight railway truck.

It is a further object of this invention to provide a railway truck having improved equalization means.

It is still a further object of this invention to provide an improved spring arrangement and slide bearing of a design to provide controlled steering friction and dynamic damping in a railway truck.

It is still a further object of this invention to provide an improved spring arrangement which serves a dual purpose of providing load transmission paths from a car body and improved means for equalization of the wheels in a truck.

BRIEF SUMMARY OF THE INVENTION

In accordance with the present invention, a railway truck includes a pair of side frames for receiving axles of a pair of wheel-axle units. The side frames are connected together at their center areas by a pivot assembly to permit pivotal movements about a horizontal axis parallel to the axles. Springs are disposed between a car body and the side frames to provide equalization for the wheels of the truck and also provide load transmission paths from the car body to the side frames.

Other objects and advantages of the present invention will be apparent and suggest themselves to those skilled in the art, from a reading of the following specification and claims, taken in conjunction with the accompanying drawings.

BRIEF DESCRIPTION OF THE DRAWINGS

FIG. 5 is a cross-sectional view taken along lines 5—5 of FIG. 3;

FIG. 6 is a cross-sectional view taken along lines 6—6 of FIG. 5; and FIG. 7 is an exploded view of the member illustrated in FIG. 5.

DESCRIPTION OF THE INVENTION

Figure 1:
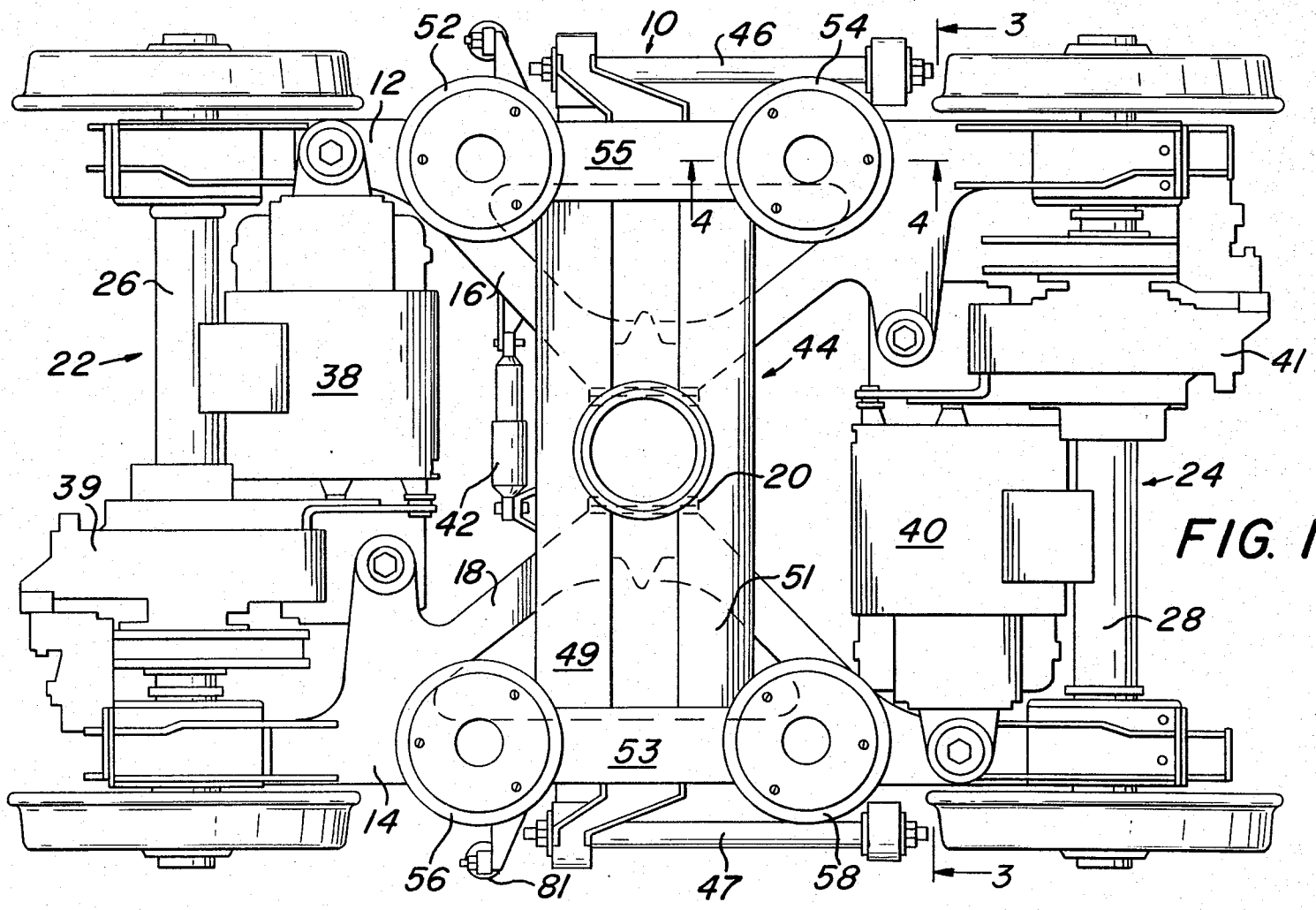
FIG. 1 is a top view of a railway truck, in accordance with the present invention.

Referring to FIGS. 1 to 4 of the drawings, a truck 10 includes a pair of side frames 12 and 14 having inwardly extending spider portions 16 and 18, respectively, somewhat similar to the portions illustrated in the aforementioned U.S. Pat. Nos. 2,908,230 and 3,020,857. The side frames and the extending portions are connected by a center pivot assembly 20 to be more clearly described in detail in connection with FIGS. 5, 6 and 7.

The truck 10 includes a pair of wheel-axle units 22 and 24. The axles 26 and 28 are received by journal bearings (not illustrated) and connected to the side frames 12 and 14. Primary suspension rings, such as rings 34 and 36 (FIG. 2) surround the journal bearings.

Figure 2:
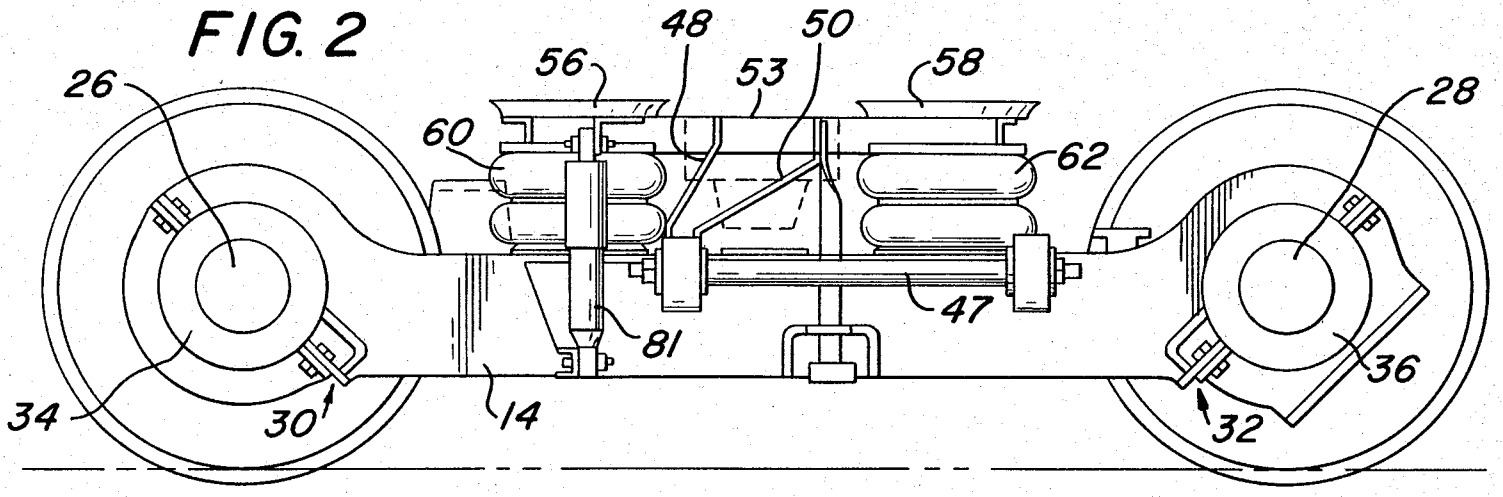
FIG. 2 is a side view of the truck illustrated in FIG. 1.

The ends of the side frames 12 and 14 include pairs of clamping mehcanisms, which only one pair 30 and 32 is illustrated in FIG. 2. The clamping mechanisms 30 and 32 clamp primary suspension rings 34 and 36, respectively, around the journal bearings and axles 26 and 28.

Motors 38 and 40 and gear boxes 39 and 41 are secured to the side frames to drive the axles 26 and 28. A lateral shock absorber 42 is connected between a steering beam or bolster 44 and the side frame 12. A pair of longitudinal anchor arms 46 and 47 are connected between the side frames 12 and 14 and the bolster 44 through arm 48 and 50, such as illustrated in FIG. 2.

The clamping mechanisms, primary suspension rings and other elements described thus far are conventional and well known to those skilled in the art.

Figure 3:
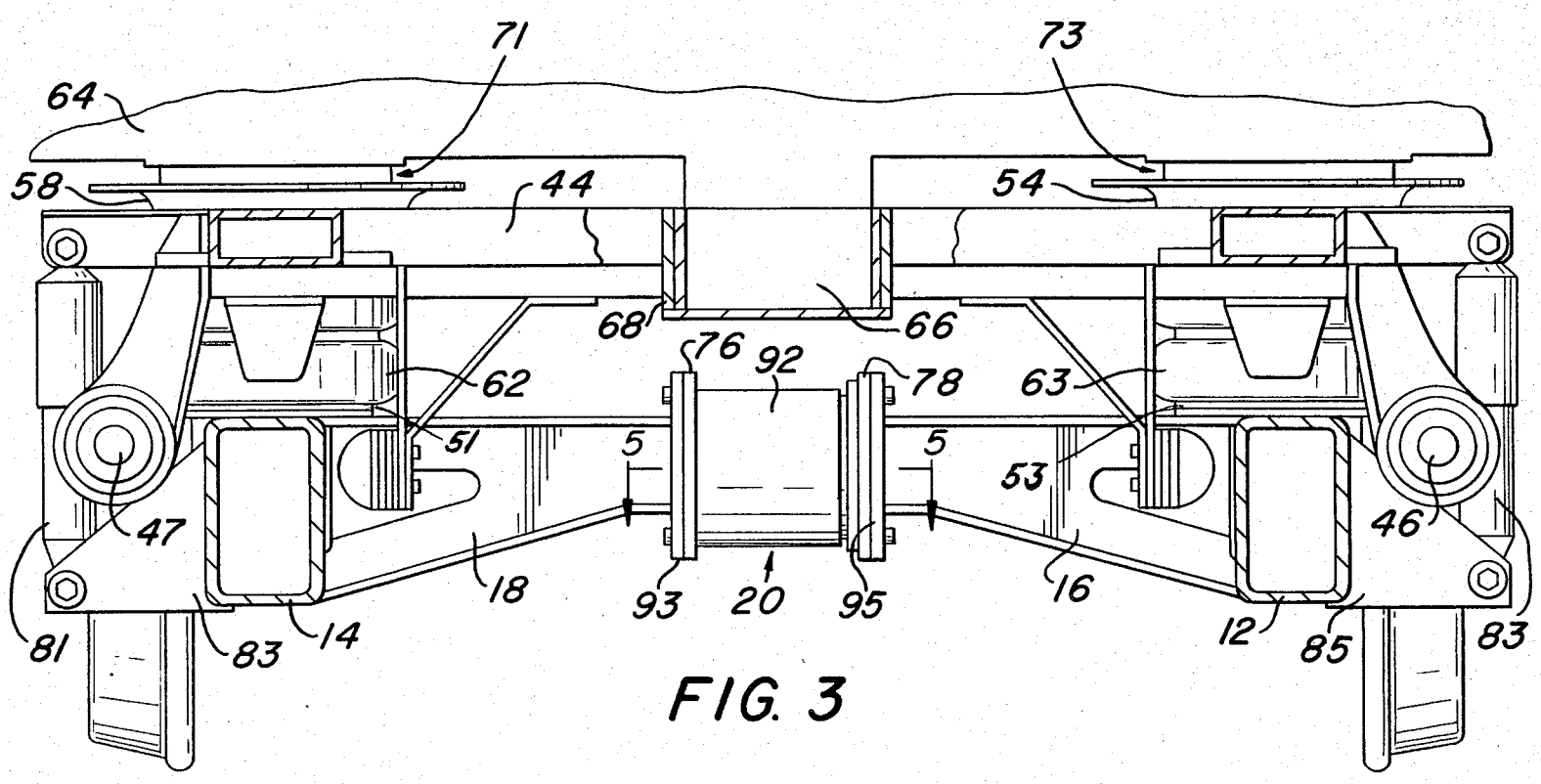
FIG. 3 is a cross-sectional view, taken along lines 3—3 of FIG. 1.

The bolster 44 comprises an assembly to provide the interface between the truck 10 and car body 64 (FIG. 3). The bolster 44 includes a pair of transverse bars or tubular elements 49 and 51 connected at their ends by elements 53 and 55. Four seal rings 52, 54, 56 and 58 are disposed at the top of four air springs, with two such springs 60 and 62 being illustrated in FIG. 2. The seal rings are disposed on the bottom of the car body and slide thereon.

The four springs are disposed on spring seats connected to the side frames 12 and 14, with two of four spring seats 51 and 53 being illustrated in FIG. 3.

Referring to FIG. 3, a pair of vertical shock absorbers 81 and 83 is connected between plates 83 and 85, secured to the side frames 14 and 12, and the bolster 44. The car body 64 includes a king pin 66. The king pin 66 is adapted to fit into a structure 68 which provides a central opening in the steering beam 44. The car body 64 is free to rotate with respect to the steering beam 44, with the seal rings moving with the beam 44. Adapters 71 and 73 are disposed to move on seal or slide elements 52, 54, 56 and 58 which are disposed on the tops of the four springs. This arrangement is illustrated in greater detail in FIG. 4.

Figure 4:
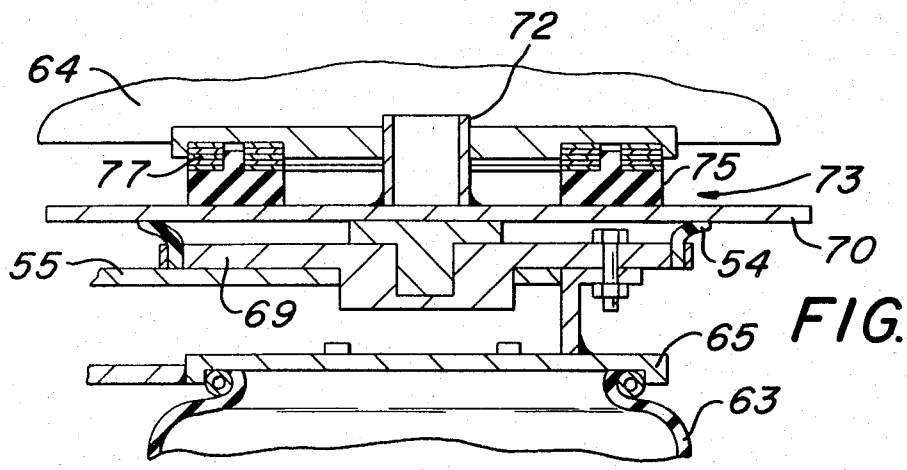
FIG. 4 is a cross-sectional view, taken along lines 4—4 of FIG. 1.

Referring to FIG. 4, one of the springs 63 is connected to a top element 65 secured to an opening in the end tubular member 55. A support member 69 is fitted into an opening in the tubular member 55 to support the seal 54. The interface attached to the car body 64 and disposed between the car body 64 and springs including spring 63 includes a plate 70. A pin member 72, an elastomeric ring 75, and shim elements 77 are connected to the plate 70.

In the arrangement illustrated, the bolster or steering arm 44 interfaces with the car body 64 and not with a conventional truck bolster. Because of this, the truck frame pivots beneath the spring plank or steering arm 44. The anchor beams and arms force the steering arm 44 to move and rotate with the truck 10. The truck then pivots on the car bodies of the rings 52, 54, 56 and 58. The rings or sliders 52, 54, 56 and 58 are very low friction material.

The shim elements 77 are provided to correct for car body imperfections and to provide levelling for the car.

In the arrangement illustrated, it is seen that the load transmission paths from the car body 64 to the side frames 12 and 14 are directly through the springs which are connected between the car body 64 and the side frames 12 and 14.

The four springs in the system are the secondary springs for the system illustrated. These same springs, however, also provide the springs to provide equalization for the wheels of the truck. In the present invention, the side beams 12 and 14 take the place of the conventional equalizer beams.

When any one of the wheels connected to the axles 24 or 26 tends to be lifted away from the rail, the spring associated with the side frames 12 and 14 closest to the lifted wheel will exert a downward force to maintain that particular wheel in contact with the rail.

In order for the side frames 12 and 14 to effectively act as equalizer beams in the embodiment illustrated, they must be free to pivot about a horizontal axis which is parallel to the axles 24 and 26. As illustrated in FIG. 1, the pivot assembly 20 connects the centers of the side frames through extending or spider sections 16 and 18 to permit pivoting of the side frames.

Referring now to FIGS. 5, 6 and 7, the center pivot assembly 20 comprises end plates 76 and 78 including projecting portions 89 and 91 to fit into plates which are attached to the end portions of the inwardly extending portions 16 and 18. The end plates 76 and 78 include corner openings 80 and 81 to permit attachment to plates 93 and 95 (FIG. 3) on the sections 18 and 16 which in turn are connected to the side frames.

The end plate 76 also includes a second set of openings 82 to permit an elastomer bearing element 84 having openings 86 to be attached thereto. One portion 85 of the bearing element 84 is tubular while an inwardly extending end section 88 includes openings 86. The plate 76 is attached to the bearing 84 by means of screws 90 passing through the openings 82 and 86. An outer tubular member 92 is welded to the plate 76 in the manner illustrated and dimensioned to surround the bearing element 84.

An elastomeric bearing member 94 including tubular section 95 and an end section 96 is adapted to be connected to the end plate 78. The end plate 78 includes openings 98 to be aligned with openings 100 in the member 94 to permit attachment of the end plate 78 to the member 94 by means of screws 102. A tubular member 104 is welded to the plate 78 in the manner illustrated and dimensioned to fit into the elastomeric bearing 94.

The dimensions of the parts illustrated in FIG. 7 are such that the outer tubular member 92 is disposed around both bearing members 84 and 94. The smaller tubular member 104 is dimensioned to slide inside or rotate within the bearing members 84 and 94.

Because the end plates 76 and 78 are secured to the side frames 12 and 14, it is seen that the side frames are free to pivot about the horizontal axis of the pivot assembly 20 with respect to each other. As illustrated in the previous drawings, this axis is parallel ot the axles 26 and 28.

Because at least one of the four springs are disposed between one of the wheels and the horizontal axis of the pivot assembly 20, and because the springs are connected between the car body and the side frames, each of the springs exert a downward force to keep all of the wheels on the rails thereby providing equalization.

The center pivot assembly 20 is capable of carrying moment. It trams the truck rigidly while still permitting the side frames to articulate freely about a horizontal axis parallel to the axles. It is easily removable from the truck without disturbing other parts in the truck. It may be of different sizes dependent upon the forces being handled.

What is claimed is:

1. In a railway truck including wheel-axle units having wheels and axles for carrying a car body,
   (a) a pair of side frames for receiving the axles of said wheel axle units;
   (b) a pivot assembly mechanism connected between the centers of said side frames to permit pivotal movement thereof about an axis parallel to said axles; and
   (c) spring means disposed between said support structure and said side frames to provide equalization of the wheels of said wheel-axle units.

2. The invention as set forth in claim 1 wherein said spring means comprises at least four springs, with at least one spring exerting a downward force is connected between the center of one of said side frames and one of the wheels.

3. The invention as set forth in claim 2 wherein said side frames include a pair of inwardly extending sections having means to receive said pivot assembly therebetween.

4. The invention as set forth in claim 3 wherein said pivot assembly mechanism includes a pair of overlapping tubular members disposed to move with respect to each other about a horizontal axis parallel to said axles.

5. The invention as set forth in claim 4 wherein said pivot assembly mechanism includes a pair of end plates secured to said overlapping tubular members, with said end plates being secured to said inwardly extending sections.

6. The invention as set forth in claim 5 wherein a pair of low friction elastomeric bearing elements are disposed between said pair of tubular members.

7. The invention as set forth in claim 6 wherein a support structure for receiving said car body thereon is provided, said support structure being disposed on said four springs.

8. The invention as set forth in claim 7 wherein slide elements are disposed above said four springs in sliding engagement with the bottom portion of said car body.

9. The invention as set forth in claim 8 wherein adapter means including plate elements are secured to said car body to engage said slide elements.

* * * * *